United States Patent [19]

Levin et al.

[11] 4,007,073

[45] Feb. 8, 1977

[54] METHOD OF PRODUCING ARTICLES HAVING ALTERNATING MAGNETIC AND NON-MAGNETIC PORTIONS FROM CONTINUOUS METAL BLANKS

[76] Inventors: Felix Lvovich Levin, Novo-Khoroshevskoe shosse, 26, korpus 3, kv. 29; Sergei Alexandrovich Golovanenko, 9 Parkovaya ulitsa, 57, korpus 3A, kv. 12; Vladimir Alexandrovich Dmitriev, ulitsa Plekhanova, 3, korpus 5, kv. 73, all of Moscow, U.S.S.R.

[22] Filed: Aug. 4, 1975

[21] Appl. No.: 601,406

Related U.S. Application Data

[63] Continuation of Ser. No. 515,023, Oct. 15, 1974, abandoned, which is a continuation of Ser. No. 371,872, June 20, 1973, abandoned.

[52] U.S. Cl. ..... 148/120; 148/39; 148/121; 148/129; 148/145; 148/148

[51] Int. Cl.[2] ..... H01F 1/00

[58] Field of Search ..... 148/120, 121, 39, 11.5, 148/13, 129; 75/126 C, 126 H, 170, 171

[56] References Cited

UNITED STATES PATENTS

| | | | |
|---|---|---|---|
| 2,382,651 | 8/1945 | Nesbitt | 75/126 H |
| 2,765,161 | 10/1956 | Mungall | 148/108 |
| 3,588,764 | 6/1971 | Olsen et al. | 75/126 H |
| 3,772,005 | 11/1973 | De Barbadillo | 75/126 C |

OTHER PUBLICATIONS

Young; J., *Materials+Processes;* New York, 1954, pp. 711–715.

Grossmann; M., *Principles of Heat-Treatment*; ASM, Cleveland, 1935, pp. 101–103 & 195–196.

Bozorth, R.; *Ferromagnetism;* New York, 1951, pp. 6, 8–10, 15, 16 & 713–719.

*Primary Examiner*—Walter R. Satterfield
*Attorney, Agent, or Firm*—Holman & Stern

[57] ABSTRACT

A method of producing articles having alternating magnetic and non-magnetic portions from a continuous metal blank includes plastic deformation of the blank portions which are to have magnetic properties imparted thereto. The blank for the articles is manufactured from a metal having an unstable austenitic structure.

8 Claims, No Drawings

METHOD OF PRODUCING ARTICLES HAVING ALTERNATING MAGNETIC AND NON-MAGNETIC PORTIONS FROM CONTINUOUS METAL BLANKS

This is a continuation of application Ser. No. 515,023 filed Oct. 15, 1974 and now abandoned, which in turn is a continuation of Ser. No. 371,872 filed June 20, 1973, both of which are now abandoned.

BACKGROUND OF THE INVENTION

The present invention relates to methods of producing articles having alternating magnetic and non-magnetic portions from continuous metal blanks.

Such articles are widely used as machine and instrument components. These articles are usually manufactured (joined together) from metals featuring different (contrasting) properties, such as, magnetic and non-magnetic properties high and low electric resistance, different coefficients of thermal expansion, different Curie points and different strength and plasticity characteristics. The metals featuring the above-specified properties are typically either bonded by welding, soldering, cementing together, pouring, cladding or by making use of mechanical connections, such as, riveting. They can be also joined together by hot or cold pressure shaping.

However, when metal articles are produced by the above-described methods, they suffer from deterioration of the properties of the metals which contribute to the formation of the magnetic and non-magnetic portions. Moreover, the fabrication of the articles composed of separate parts is associated with a number of technological problems. Thus, metals having different crystalline structures, such as, steels belonging to an austenitic (non-magnetic) and martensitic (magnetic) class can be bonded together by welding. In order to prevent hot cracking, austenitic steels are welded with a low arc heat input and a maximum possible cooling rate. Martensitic steels, to prevent cold cracking they are welded with high arc heat inputs and with an accompanying tempering or preheating steps to prevent the formation of cold cracks. However, when welding magnetic and non-magnetic metals, the use of the above-specified techniques adversely affects the properties of one of the metals being connected, and results in a reduction in strength, plasticity and impact toughness. In addition, the metals joined together by welding are subjected to temperatures approaching their melting points thus ensuing the alteration of their initial structures and with the magnetic properties of the article being uncontrollable in the welding zone. Local mixing of the metal is also conducive to uncontrollable properties at the metal weld. As a rule, a weld joint is inferior in strength to the base metal. For certain constructions welding is not applicable and the welding of heterogeneous metals presents certain problems or is not feasible.

Joining metals together by a combined hot and cold pressure treatment or by pouring one metal into another enables the production of a strong article. However, such a monolithic article consists of metals differing in their crystalline structures, such as, one metal having an austenitic non-magnetic structure and another metal having a martensitic magnetic structure. Heat treatment of a bimetallic blank results in a sharp deterioration of the magnetic and mechanical characteristics of one of the metals from which the articles has been fabricated so that it is difficult and sometimes impossible to improve the properties of the magnetic and non-magnetic portions with the aid of heat treatment.

Mechanical connecting and cementing of magnetic and non-magnetic metals cannot ensure high reliability, stress-rupture properties and serviceability of the articles thus produced.

The inventors have disclosed in application Ser. No. 515,663 filed Oct. 17, 1974 now U.S. Pat. No. 3,953,252 a method of producing metal articles having magnetic and non-magnetic portions, comprising heat treating separate portions of a continuous metal blank manufactured from a metal of a specified chemical composition to a temperature ranging from 450° to 1000° C. and heating the other portions to a temperature exceeding 1000° C to the melting point of the blank with the integrity of the blank being undisturbed.

The results of the above method were superior to those attainable heretofore.

It is common knowledge that certain alloys upon being subjected to an appropriate heat treating operation acquire or lose their magnetic properties. An alloy containing, in percent by weight: 12–14 vanadium and 50–52 cobalt and featuring low magnetic properties, and upon being subjected to cold working, acquires the properties of a magnetically hard material. (E. Gudreman "Special Steels", USSR, Metallurgia Publishers, 1966, Vol. 2, p.967).

The inventors have taken into account these phenomena in their containing research aimed at selecting the proper material for the blanks and the proper combination of heat treatment and deformation. In addition, blanks of different configuration have been studied and subjected to different kinds of deformation.

The known methods do not allow for the changing of the configuration of the magnetic and non-magnetic portions by local heat treatment.

Components having magnetic and non-magnetic portions find application in electronic computers. However, the components manufactured by cementing together magnetic and non-magnetic materials have inadequate life periods.

In cybernetics use is made of parts having magnetic and non-magnetic portions, the parts being fabricated by depositing magnetic powders on a non-magnetic substratum (a matrix, strip or backing, e.g. in plastics). To this end the matrix portions which are to remain non-magnetic are covered with an impervious film, whereas those portions which are to become magnetic remain exposed. However, the deposited magnetic layer does not have the requisite longevity.

The lack of procedure which would enable the production of strong metal articles having magnetic and non-magnetic portions creates difficulties in a number of industries.

SUMMARY OF THE INVENTION

The principal object of the invention is to provide a method of producing articles having alternating magnetic and non-magnetic portions from a continuous metal blank which method ensures the fabrication of strong monolithic articles.

Another, no less important, object of the invention is to provide a method which would give the requisite configuration to the magnetic and non-magnetic portions by subjecting them to local heat treatment and plastic deformation.

These and other objects are achieved by providing a method of producing articles having alternating magnetic and non-magnetic portions from continuous metal blanks, wherein, according to the invention, the blank whose metal has an unstable austenitic structure is subjected to plastic deformation with a reduction degree varying from 0.1 to 99.9% over a temperature range of from 0° to 800° C including the portions which are to be imparted the properties of a magnetic material.

The above method ensures the production of strong monolithic articles having magnetic and non-magnetic portions which may be exposed to power loads (i.e. can be subjected to extension, compression and bending).

Initially the entire blank can be subjected to plastic deformation and then the portions which are to be made non-magnetic can be heated at least once to a temperature ranging from 1000° to 1350° C.

The herein-proposed method of producing articles having magnetic and non-magnetic portions can be accomplished most easily and makes it possible to preclude the decomposition of the austenitic non-magnetic structure.

It is desirable that the blank portions subjected to the plastic deformation be heated within a temperature range of from 450° to 850° C and held for from 0.5–200 hrs. This enhances the magnetic characteristics of the magnetic material.

The above-described articles may be manufactured from a blank whose metal has the following chemical composition, by weight: 0.03–0.3%, carbon; 12–17%, chromium; 30–55% cobalt, up to 7%, molybdenum and the balance being iron.

The metal has an unstable austenitic structure and upon being subjected to plastic deformation acquires the properties of a magnetic material.

The blank portions which are to become magnetic may have a cross section exceeding that of the portions which are to remain non-magnetic by the reduction step the blank being reduced so as to equalize its cross section over its entire length.

In this case an article produced from a sheet, bar or pipe blank, upon being subjected to plastic deformation on a rolling mill, will have a smooth external surface with alternating magnetic and non-magnetic portions.

Illustrative examples of the embodiment of the hereinproposed method of producing metal articles having magnetic and non-magnetic portions are given hereinbelow.

DETAILED DESCRIPTION OF THE PREFERRED EMBODIMENT

EXAMPLE 1

A continuous blank from a metal containing 0.03 wt % of carbon, 13.4 wt % of chromium, 37.3 wt % of cobalt, 0.37 wt % of manganese, 0.02 wt % of silicon, 0.39 wt % of vanadium and the balance being iron was used. The blank was subjected to hot plastic deformation within a temperature range of from 1150° to 800° C.

Then the blank portion (one end) which was to be made magnetic was exposed to plastic deformation (drawing through dies). Prior to this the specified portions had a cross section exceeding that of the non-magnetic portions, after which the blank was drawn through the dies. The last die was fitted with an opening corresponding in size with the cross section of the non-magnetic portions, so that the non-magnetic portions were not subjected to plastic deformation.

Tests showed that the blank portions subjected to the local plastic deformation had the following magnetic properties depending on the reduction degree: saturation induction $B_s$ of up to 21,000 gsec, residual induction $B_r$ of up to 6,500 gsec and coercive force $H_c$ of up to 230 oersteds.

In this case the portions not subjected to plastic deformation were non-magnetic.

EXAMPLE 2.

A continuous blank from a metal containing 0.2 wt % of carbon, 13.6 wt % of chromium, 37.5 wt % of cobalt, 0.38 wt % of manganese, 0.28 wt % of silicon and the balance being iron, was used. The blank was subjected to hot plastic deformation within a temperature range of from 1150° to 800° C. Then it was heated to a temperature of 1100° C, held to equalize the temperature over its cross section and cooled. Part of the blank was taken exposed to plastic deformation (drawing through dies) and then heated to a temperature of 650° C, held for 1 hour and cooled. This enabled the residual induction and coercive force of the magnetic portions to be enhanced (subjected to local plastic deformation), with the remaining portions preserving their non-magnetic properties.

EXAMPLE 3

A continuous blank from a metal containing 0.2 wt % of carbon, 13.6 wt % of chromium, 37.5 wt % of cobalt, 0.38 wt % of manganese, 0.28 wt % of silicon and the balance being iron was used. The blank was subjected to hot plastic deformation within a temperature range of from 1150° to 800° C and cold plastic deformation, whereupon it was heated to 650° C, held at this temperature for an hour then cooled.

The blank acquired the properties of a magnetic material. The portions which were to be made non-magnetic were heated by high-frequency currents or laser beams to a temperature of 1200° C and then cooled.

The above heating permitted the non-magnetic portions to have small surface areas, such as points, lines, symbols and spots.

Magnetic portions having small surface areas and a given shape may be produced as a result of deformation (impact loads).

EXAMPLE 4.

A continuous blank from a metal containing 0.25 wt % of carbon, 12.1 wt % of chromium, 37.5 wt % of cobalt, 0.45 wt % of manganese, 0.32 wt % of silicon and the balance being iron was used. The blank was subjected to hot plastic deformation within a temperature range of from 1120° to 800° C, whereupon it was heated to a temperature of 1150° C, held at this temperature to equalize the temperature along the entire article cross section and then cooled. The portions which were to be made magnetic were subjected to plastic deformation (drawing through dies) with subsequent heating to a temperature of 650° C. Then they were held for an hour at this temperature and then cooled. This made it possible to improve the magnetic properties of the portions being subjected to local deformation whereas those not exposed to deformation remained practically non-magnetic.

EXAMPLE 5

A blank from a metal containing 0.21 wt % of carbon, 0.26 wt % of manganese, 0.1 wt % of silicon, 12.45 wt % of chromium, 38.00 wt % of cobalt and the balance being iron was subjected to hot plastic deformation within a temperature range of from 1180° to 850° C. Then the blank was heated to 1050° C, held at this temperature to heat the metal throughout and then cooled in water to fix the austenitic structure. After that underwent cold plastic defomation which resulted in the formation of a martensitic structure, whereafter it was heated to a temperature of 600° C to enhance its magnetic characteristics and held at this temperature for 3 hrs. The specified portions of the blank were subjected to local heating to 1200° C so that they acquired a non-magnetic austenitic structure.

EXAMPLE 6

A blank from a metal containing 0.03 wt % of carbon; 0.36 wt % of manganese; 0.12 wt % of silicon; 12.7 wt % of chromium; 33.1 wt % of cobalt; 6.2 wt % of molybdenum and the balance being iron was subjected to hot plastic deformation within a temperature range of from 850° to 1180° C, then it was heated to 1100° C, held at this temperature to heat throughout the blank and then cooled in water. Following that the portions which were to be magnetic were exposed to plastic deformation. The portions subjected the deformation acquired magnetic properties and those which did not undergo deformation remained non-magnetic.

An article produced by the above-described method and having both magnetic and non-magnetic portions may function as a component part of a measuring instrument.

What we claim is:

1. A method of producing an integral metal article having both magnetic and non-magnetic portions comprising the steps of: selecting a metal article made of an alloy having an unstable austenitic structure and consisting essentially of, by weight, 0.03–0.3% carbon, 12–17% chromium, 30–55% cobalt, up to 7% molybdenum and the balance being iron; and plastically deforming portions of the article intended to form a magnetic structure at a temperature of from 0° to 800° C until the portions acquire the magnetic structure.

2. The method as claimed in claim 1, further comprising the step of: heating the portions having the magnetic structure after the plastic deformation step to a temperature of from 450° to 850° C for a period of from 0.5 to 200 hours.

3. The method as claimed in claim 1, further comprising, prior to the plastic deformation step, the steps of: plastically deforming the entire metal article at a temperature of from 800° to 1180° C; and then heating the plastically deformed article to a temperature of from 1050° to 1150° C.

4. The method as claimed in claim 1, wherein the metal article is made of an alloy consisting essentially of, by weight, 0.03% carbon, 13.4% chromium, 37.3% cobalt, 0.37% manganese, 0.20% silicon, 0.39% vanadium and the balance being iron.

5. The method as claimed in claim 1, wherein the metal article is made of an alloy consisting essentially of, by weight, 0.2% carbon, 13.6% chromium, 37.5% cobalt, 0.38% manganese, 0.28% silicon and the balance being iron.

6. The method as claimed in claim 1, wherein the metal article is made of an alloy consisting essentially of, by weight, 0.21% carbon, 12.45% chromium, 38.00% cobalt, 0.26% manganese, 0.1% silicon and the balance being iron.

7. The method as claimed in claim 1, wherein the metal article is made of an alloy consisting essentialy of, by weight, 0.03% carbon, 12.7% chromium, 33.1% cobalt, 6.2% molybdenum, 0.36% manganese, 0.12% silicon and the balance being iron.

8. A method of producing an integral metal article having both magnetic and non-magnetic portions comprising the steps of: selecting a metal article made of an alloy having an unstable austenitic structure and consisting essentially of, by weight, 0.03–0.3% carbon, 12–17% chromium, 30–55% cobalt, up to 7% molybdenum and the balance being iron; plastically deforming the metal article at a temperature of from 0° to 800° C to form a magnetic structure throughout the entire metal article; and heating portions of the metal article intended to form a non-magnetic structure to a temperature of from 1000° to 1350° C.

* * * * *